US009511482B2

(12) United States Patent
Stonefield

(10) Patent No.: US 9,511,482 B2
(45) Date of Patent: Dec. 6, 2016

(54) DRIVE BIT

(71) Applicant: Peter A Stonefield, Charleston, SC (US)

(72) Inventor: Peter A Stonefield, Charleston, SC (US)

( * ) Notice: Subject to any disclaimer, the term of this patent is extended or adjusted under 35 U.S.C. 154(b) by 318 days.

(21) Appl. No.: 14/337,706

(22) Filed: Jul. 22, 2014

(65) Prior Publication Data

US 2015/0033915 A1 Feb. 5, 2015

Related U.S. Application Data

(60) Provisional application No. 61/861,133, filed on Aug. 1, 2013.

(51) Int. Cl.
*B25B 13/50* (2006.01)
*B25B 21/00* (2006.01)

(52) U.S. Cl.
CPC ..... *B25B 13/5091* (2013.01)

(58) Field of Classification Search
CPC ..... B25B 13/5091; B25B 21/007
See application file for complete search history.

(56) References Cited

U.S. PATENT DOCUMENTS 4,724,731 A * 2/1988 Onofrio ..... B25B 23/00 81/119
4,823,650 A * 4/1989 Tuttle ..... B25B 23/12 81/124.2
4,984,489 A * 1/1991 Krauthamer ..... B25B 13/48 81/121.1
5,697,268 A 12/1997 Makovsky et al.
5,791,208 A * 8/1998 Grubbs ..... B25B 13/5091 81/121.1
5,943,922 A 8/1999 Rolfe
6,626,068 B2 * 9/2003 McKivigan ..... B25B 13/5091 81/124.2
6,711,974 B1 * 3/2004 Lin ..... B25B 13/5091 81/125
6,715,384 B1 4/2004 Kozak
6,729,210 B2 5/2004 Morris
6,854,364 B1 * 2/2005 Tassano ..... B25B 13/5091 81/121.1
7,878,093 B1 2/2011 Peterman
9,221,155 B1 * 12/2015 Cantlon ..... B25B 13/06 81/119
2002/0096023 A1 * 7/2002 Sanford ..... B25B 13/5091 81/124.2
2005/0132848 A1 * 6/2005 Tassano ..... B25B 13/5091 81/121.1

* cited by examiner

*Primary Examiner* — David B Thomas
(74) *Attorney, Agent, or Firm* — Ernest B. Lipscomb; Barnwell Whaley Patterson & Helms

(57) ABSTRACT

A drive bit used with a drill for installing a small diameter shanked cup hook or eyebolt into a stationary surface. The drive bit includes a tubular member integrally joined to the shaft. The shaft has a hexagonal cross-section shaped shank and includes a detent for insertion of the grip end into the chuck of a power tool, or the socket of a manual driver. The tubular member has opposite forward and rear ends and a central axis of rotation extending through the ends. The tubular member has at least one longitudinal extending from near the rear end through said forward end of said tubular member, said slot being sized to accept a fastener. The length of the slot is predetermined to allow the selection of a variety of shanked cup hooks or small eyebolts.

7 Claims, 1 Drawing Sheet

DRIVE BIT

CROSS-REFERENCE TO RELATED APPLICATIONS

The contents of Provisional application U.S. Ser. No. 61/861,133 filed Aug. 1, 2013, on which the present application is based and benefit claimed under 35 U.S.C. §119(e), is incorporated by reference.

BACKGROUND OF THE INVENTION

1. Field of the Invention

The present invention relates generally to tools, in particular socket tools. More particularly, the present invention relates to a drive bit designed to accommodate fasteners, such as cup hooks and eyebolts which normally are not adaptable for direct engagement with conventional screw-type fasteners.

2. Description of Related Art

The use of eyebolts and cup hooks are convenient ways to hang items in a garage or to string lights such as Christmas lights at the eaves of a house. When installing eyebolts or cup hooks manually the pointed tip is pressed against a surface and the fastener rotated by hand using the eye or hook portion of the fastener. The process can be made easier by forming a lead hole. When installing Christmas lights, there may be several hundred or more hooks used. Moreover, installing eyebolts and cup hooks can be tiring, time consuming and difficult.

Various adaptors, e.g., socket tools, for installing and removing eyebolts and screws with drills are known. These adaptors are generally dedicated to one particular type or size of cup hook or eyebolt. Also, many of these adaptors are complicated and difficult to use as well as being time consuming to assemble and use. Accordingly, there is a need for a simple, yet effective tool for installing and removing eyebolts and cup hooks of varying sizes that may be used with a power tool.

SUMMARY OF THE INVENTION

It is therefore the general object of the present invention to provide a device used to install cup hooks and eyebolts that does not employ manual turning or pre-drilling to facilitate installation.

Another object of the present invention is to employ a device for installing cup hooks and eyebolts into surfaces that do not necessarily have to be on a vertical plane.

Another object of the present invention is to provide a socket tool capable of holding cup hooks and eyebolts to be installed using an adjustable drill bit receptacle from most power drills or hand tools.

Yet another object of the present invention is to provide a socket tool for installing cup hooks and eyebolts that distributes back pressure when an item is drilled into a surface.

Still another object of the present invention is to provide a method of installing cup hooks and eyebolts that is easy, quick and inexpensive to manufacture since the article can be manufactured using any commercial multi-axis machine.

A still further object of the present invention is to provide a means of installing cup hooks and eyebolts having many advantages which include facilitating the hanging of holiday decorations, avoiding the fatigue of hand screwing and providing for the easy removal of cup hooks and eyebolts.

An even further object of the present invention is to provide a device for installing cup hooks and eyebolts that will allow a user to exert reasonable, controllable driving force without damaging the cup hook or eyebolt.

The present invention provides a positioning device that holds a cup hook or eyebolt in the device so that the user by simply positioning the device may easily install the cup hook or eye bolt. The drive bit comprises a grip end having a tubular member integrally joined to the shaft. The grip end is a shaft having a hexagonal cross-section shaped shank forming a rotational axis about its center. The shank includes a detent for insertion of the grip end into the chuck of a power tool, or the socket of a manual driver that provides rotary motion. The detent allows the shank to seat into the adjustable drill bit receptacle of most power drills or hand tools, such as the standard bit driver, socket wrench driver, hand drill or other mechanical tool.

The tubular member has opposite forward and rear ends and a central axis of rotation extending through the ends. While the tubular member is preferably cylindrically shaped, other shapes are possible so long as they are suitably balanced for rotation about the axis of rotation. The tubular member has a single centrally located longitudinal slot of a fixed width bifurcating the forward end of the tubular member forming a pair of opposing side walls. The depth or length of the slot is selected to be at least as great as the diameter of the fastener rod. The slot is designed such that it accommodates a variety of screw hooks and eyebolts with different widths and thicknesses on the hook drive end.

Other objects, features and advantages of the present invention will become apparent from the following detailed description of the invention taken in conjunction with the accompanying drawings.

BRIEF DESCRIPTION OF THE DRAWINGS

Having described the invention in general terms, reference will now be made to the accompanying drawings, which are not necessarily drawn to scale, and wherein.

DESCRIPTION OF THE PREFERRED EMBODIMENT(S)

The present inventions now will be described more fully hereinafter with reference to the accompanying drawings, in which preferred embodiments of the invention are shown. This invention may, however, be embodied in many different forms and should not be construed as limited to the embodiments set forth herein; rather these embodiments are provided so that this disclosure will be through and complete and will fully convey the scope of the invention to those skilled in the art. Like numbers refer to the elements throughout.

Figure 1:
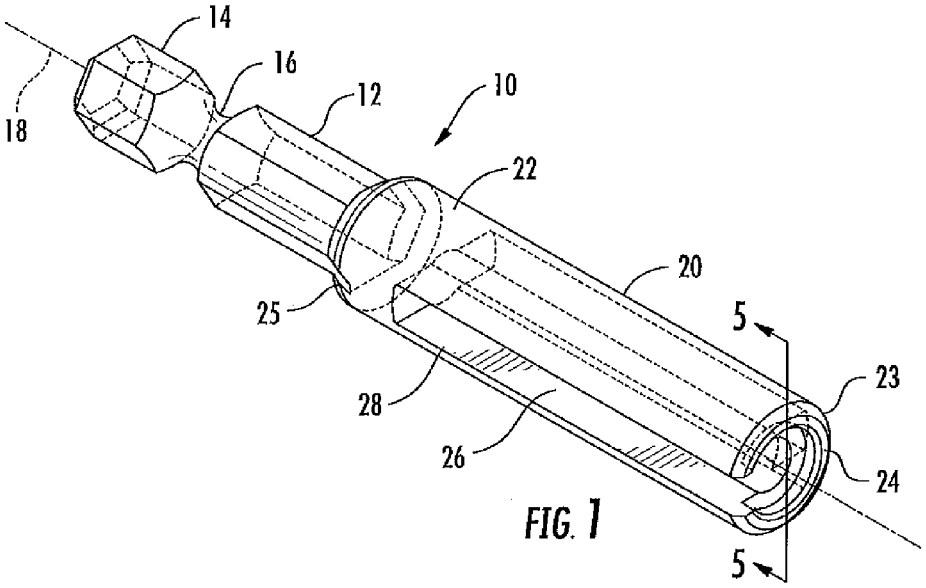
FIG. 1 is a perspective view of the drive bit of the present invention
Figure 2:
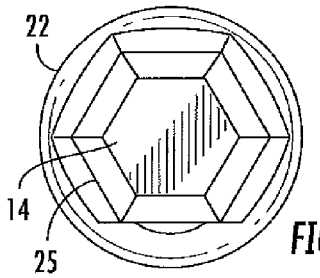
FIG. 2 is a plan view showing the shank at the grip end of the drive bit of the present invention.

Referring now to the drawing and in particular FIG. 1, there is shown a preferred embodiment of the drive bit 10 for holding eyebolts and hook screws of the present invention during installation. The drive bit 10 has a grip end and a body end. The grip end comprises a shank 12 that preferably has a hexagonal cross-section. A rotational axis 18 extends through the drive bit 10 including the grip end and the body. FIG. 2 shows an embodiment of the grip end of the drive bit 10 directed toward the butt end of shank 12. The grip end provides an end or butt portion 14 that includes a detent 16 for insertion into the chuck of a power tool, or the socket of a manual driver that provides rotary motion. The detent 16 allows the shank 12 to fit into an adjustable drill bit receptacle or hand tool, such as the standard bit driver, socket wrench driver, hand drill or other manual or mechanical tools.

Figure 3:
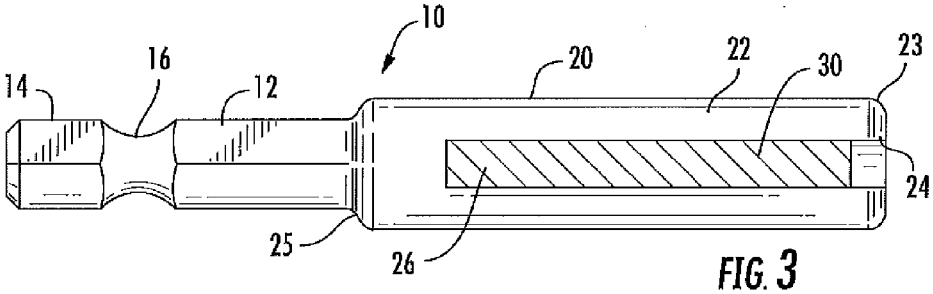
FIG. 3 is a side view of the drive bit of the present invention and illustrating the fastener receiving slot.

As shown in FIG. 3, the body 20 of the drive bit 10 is preferably a smooth tubular-like member 22. The body 20 has a forward end 23, rear end 25, and as stated an axis of rotation 18 extending there through. While the tubular-like member 22 is preferably cylindrical, other shapes are possible so long as they are suitably balanced for rotation about the axis of rotation. The tubular member 22 and the shank 12 are made of a rigid material such as steel, hardened plastic, aluminum or the like.

Figure 4:
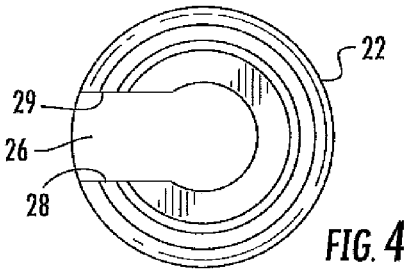
FIG. 4 is a plan view showing the tubular member of the present invention from the front end.

The tubular member 22 has a first longitudinal slot 26 extending from near the rear end 25 through the forward end 23 of the tubular member with the slot being sized to accept a fastener. The slot 26 forms a pair of opposing side walls 28, 29 as shown in FIG. 3. The embodiment shown in FIG. 4 illustrates the tubular member 22 having a slot 26 in one side of tubular member 22. There is also a second longitudinal slot 30 on the opposite side of said tubular member extending from near the rear end almost to the forward end 23 of said tubular member and sized to accept a portion of a fastener 31. As shown most clearly in FIG. 3, the slot 26 extends from near the rear end 25 of the tubular member 22 up through the top of the tubular member 22. The width of the slot 26 is selected so as to be at least as great as the diameter of the fastener. The slot 26 is designed such that the drive bit 10 can be used with a variety of cup hooks and eyebolts with different thicknesses. The embodiment shown in FIG. 5 has a recessed area 24 surrounding the forward end 23 of tubular member 22 that assists in guiding the fastener 31 into it proper location in the tubular member.

Figure 5:
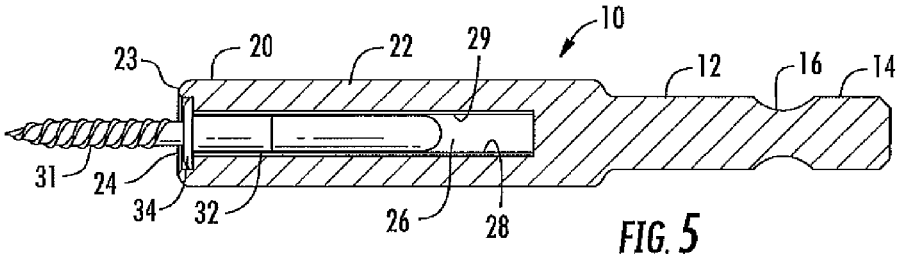
FIG. 5 is a side view of the drill bit of the present invention similar to that of FIG. 3 expect the drive bit is reversed end over end and is taken along line 5-5 of FIG. 1 of the tubular member portion of showing the slot that receives the fastener and illustrating a cup hook for loading into the drive bit.

A variety of fasteners may be installed using the drive bit of the present invention. For example, cup hooks 31, such as shown in FIG. 5, having a rounded hook portion of variable width/thickness 32 and, in some cases, a flanged seat 34 separating the rounded section from the threaded end 33. An eyebolt (not shown) having a circular eye of variable width/thickness and, in some cases, a flanged seat separating the rounded section from the threaded end are also easily installed using the drive bit of the present invention.

As shown more clearly in FIG. 4, the side walls 28, 29 of the slot 26 are preferably planar giving slot 26 has a rectangular shape. Thus, the slot 26 is adapted to slideably receive a portion of a fastener, such as an eyebolt, cup hook or other similar member. The width of the slot 26 is slightly larger than the diameter of the non-threaded portion of the eyebolt or cup hook.

In operation, a fastener is placed within slot 26 with the threaded end outward from the top of the tubular member 22 and resting on shoulder 23. the hook or eye end is held within the tubular member 22 and the hook or eye end may extend partially through slot 30. The drill with the fastener is placed in the desired position and activated. When the fastener—cup hooks and eyebolts—are installed into a surface back pressure from the drill advises that the installation is complete. The tubular member 22 of the drive bit 10 is simply slid from the fastener.

The design of the invention allows for rotation of the tool so that the cup hooks or eyebolts may be installed to any reasonable angle. The present invention provides a method of installing cup hooks and eyebolts that is easy, quick and inexpensive to manufacture since the article can be manufactured using any commercial multi-axis machine. The present invention also provides a means of installing cup hooks and eyebolts in different locations at different elevations and/or with different volumes of access room.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A drive bit comprising:

a grip end comprising a shank having a rear end and a forward end; and a body having a forward end a rear end, said rear end of said body being attached to the forward end of said shank, said body comprising a tubular member, having a first longitudinal slot extending from near the rear end through the forward end of said tubular member, said slot forming a pair of planer walls facing each other forming a generally rectangular shape and being sized to accept a fastener, and a seating member surrounding said forward end of said tubular member that assists in seating said fastener in said tubular member; and said grip end and said body having a rotational axis extending there through.

2. The drive bit of claim 1 further comprising a second longitudinal slot on the opposite side of said tubular member extending from near the rear end almost to the forward end of said tubular member said second longitudinal slot forming a pair of planer walls facing each other forming a generally rectangular shape and sized to accept a portion of a fastener.

3. The drive bit of claim 1 wherein said shank includes a detent position along said shank for assisting insertion into the chuck of a power tool.

4. The drive bit of claim 1 wherein said seating member has a recessed area surrounding said forward end of said tubular member that assists in seating a fastener.

5. The drive bit of claim 1 wherein said elongated shank has a hexagonal configuration.

6. The drive bit of claim 1, wherein said tubular member has a generally circular outside diameter.

7. A drive bit for holding eye bolts and hook screws during installation comprising:

an elongated hexagonal shaped shank having a rear end and a front end and a detent positioned along said shank for assisting insertion into the chuck of a power tool;

a body having a forward end a rear end, said rear end of said body being attached to the forward end of said shank, said body comprising a tubular member, and a first longitudinal slot extending from near the rear end through said forward end of said tubular member forming a pair of planer walls facing each other, said slot being generally rectangular in shape and said slot being sized to accept a fastener;

a second longitudinal slot on the opposite side of said tubular member extending from near the rear end almost to the forward end of said tubular member forming a pair of planer walls facing each other, said slot being generally rectangular in shape and sized to accept a portion of a fastener;

a seating member having a recessed area surrounding said forward end of said tubular member that assists in seating said fastener in said tubular member; and providing a rotational axis extending through said drive bit.

* * * * *